US012655606B2

(12) United States Patent
Morikawa et al.

(10) Patent No.: US 12,655,606 B2
(45) Date of Patent: Jun. 16, 2026

(54) CONSTRUCTION MACHINE

(71) Applicant: HITACHI CONSTRUCTION MACHINERY CO., LTD., Tokyo (JP)

(72) Inventors: Masatoshi Morikawa, Ushiku (JP); Shigeru Hirasawa, Mito (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 486 days.

(21) Appl. No.: 18/025,246

(22) PCT Filed: Nov. 10, 2021

(86) PCT No.: PCT/JP2021/041287
§ 371 (c)(1),
(2) Date: Mar. 8, 2023

(87) PCT Pub. No.: WO2022/123986
PCT Pub. Date: Jun. 16, 2022

(65) Prior Publication Data

US 2024/0026641 A1 Jan. 25, 2024

(30) Foreign Application Priority Data

Dec. 10, 2020 (JP) ..... 2020-205001

(51) Int. Cl.
*E02F 9/08* (2006.01)

(52) U.S. Cl.
CPC ..... *E02F 9/0808* (2013.01); *E02F 9/0866* (2013.01); *E02F 9/0891* (2013.01)

(58) Field of Classification Search
CPC ..... B60R 11/02; E02F 9/00; E02F 9/0808; E02F 9/0866; E02F 9/0891; E02F 9/2033
(Continued)

(56) References Cited

U.S. PATENT DOCUMENTS 4,907,667 A * 3/1990 Yamamoto ..... B60J 5/0487 49/394
2010/0025136 A1* 2/2010 Matsushita ..... E02F 9/18 296/190.08

(Continued)

FOREIGN PATENT DOCUMENTS

JP 2002-322676 A 11/2002
JP 2008-038438 A 2/2008

(Continued)

OTHER PUBLICATIONS

Geo-Tronics; product website; https://geo-tronics.com/product/topcon-gnss-receiver-soft-case-yellow/?srsltid=AfmBOorNRgZf83Dma74CIG0s73-F5JkhEp-ngmAs7yKZ7CMu94GchROq; accessed May 21, 2025, published Nov. 9, 2020. (Year: 2019).*

(Continued)

*Primary Examiner* — Amy R Weisberg
*Assistant Examiner* — Philip Charles Adams
(74) *Attorney, Agent, or Firm* — MATTINGLY & MALUR, PC

(57) ABSTRACT

An upper revolving structure 3 of a hydraulic excavator 1 includes a heat exchanger room 12 and a pump room 13 that respectively accommodate first and second antenna devices 24, 27 removed from first and second antenna attaching tools 25, 28 in a state where antenna-side cables 26A, 29A are connected to the first and second antenna devices 24, 27, and first and second antenna retaining tools 30, 33 that are arranged inside the heat exchanger room 12 and the pump room 13 to retain the first and second antenna devices 24, 27 removed from the first and second antenna attaching tools 25, 28. A housing cover 11 is configured to cover the heat exchanger room 12 and the pump room 13 in an openable or closable manner and include a left rear side door 16 and a (Continued)

right side door 19 that can be locked in a state where the heat exchanger room 12 and the pump room 13 are closed.

10 Claims, 9 Drawing Sheets

(58) Field of Classification Search
USPC ..... 296/187.01
See application file for complete search history.

(56) References Cited

U.S. PATENT DOCUMENTS

| | | | |
|---|---|---|---|
| 2014/0133947 | A1 | 5/2014 | Nishimura |
| 2015/0125248 | A1 | 5/2015 | Sasaki |

FOREIGN PATENT DOCUMENTS

| | | | |
|---|---|---|---|
| JP | 2008-104106 | A | 5/2008 |
| JP | 2012-219516 | A | 11/2012 |
| JP | 5315481 | B1 | 10/2013 |
| JP | 2015-021320 | A | 2/2015 |
| JP | 2015-90050 | A | 5/2015 |
| JP | 2020-007700 | A | 1/2020 |
| KR | 20-1998-0011471 | U | 5/1998 |

OTHER PUBLICATIONS

Ironworker Gear; product website; https://www.ironworkergear.com/collections/hard-hat-racks-holders/products/rack-em-mount-anywhere-hard-hat-rack-rk5001; accessed May 21, 2025, published Nov. 22, 2019. (Year: 2019).*

International Search Report of PCT/JP2021/041287 dated Jan. 25, 2022.

Korean Office Action received in corresponding Korean Application No. 10-2023-7008128 dated Sep. 10, 2025.

* cited by examiner

CONSTRUCTION MACHINE

TECHNICAL FIELD

The present invention relates to construction machines on which antenna devices are mounted.

BACKGROUND ART

In general, a hydraulic excavator representative of a construction machine is provided with an automotive lower traveling structure, an upper revolving structure mounted on the lower traveling structure to be capable of revolving thereto, and a working mechanism disposed on the front side of the upper revolving structure. Here, there is known a hydraulic excavator in which two antenna devices are mounted on an upper revolving structure. This antenna device is composed of, for example, a GNSS (Global Navigation Satellite System) antenna of a GPS (Global Position System) antenna or the like, and positional information of the hydraulic excavator is measured based upon the positional information of the two antenna devices to support the construction management for an excavating work and the like (refer to Patent Document 1).

Incidentally, the antenna device is very expensive, and therefore, in a case of carrying out the operation without using the antenna device or in a case of transporting the hydraulic excavator by using a transport vehicle, it is necessary to prevent the antenna device from being damaged by flying stones or the like. In addition, in a case where the operation of the hydraulic excavator is stopped, it is necessary to prevent theft of the antenna device. Therefore, in a case of carrying out the work without using the antenna device or in a case where the operation of the hydraulic excavator is stopped, there is adopted a method for removing the antenna device from a vehicle body and, for example, storing it within a lockable cab or taking it back to a warehouse for storage.

PRIOR ART DOCUMENT

Patent Document

Patent Document 1: Japanese Patent Laid-Open No. 2015-21320

SUMMARY OF THE INVENTION

However, cables are connected to the antenna devices for connection thereof to a controller. Therefore, the antenna devices are removed from the vehicle body, and in a case of storing the removed antenna devices in the cab, the warehouse or the like, the work of removing the cables from the antenna devices becomes necessary. In addition, in a case of attaching the antenna devices stored in the cab or the like to the vehicle body, the work of connecting the cables to the antenna devices becomes necessary. Therefore, there is posed a problem that the work of removing the antenna devices from the vehicle body for the storage and the work of attaching the stored antenna devices to the vehicle body becomes complicated.

An object of the present invention is to provide a construction machine that can enhance workability on the work of removing an antenna device from a vehicle body for the storage and on the work of attaching the stored antenna device to the vehicle body.

An aspect of the present invention is provided with a construction machine comprising: an automotive vehicle body; and a working mechanism disposed on the front side of the vehicle body, wherein the vehicle body includes: a vehicle body frame; a housing cover disposed in the vehicle body frame; an antenna attaching tool disposed in the vehicle body; and an antenna device that is removably attached to the antenna attaching tool and is connected via a cable to a controller, characterized in that the vehicle body includes: an antenna accommodation room that is disposed in the inside of the housing cover to accommodate the antenna device removed from the antenna attaching tool in a state where the cable is connected to the antenna device; and an antenna retaining tool that is disposed in the antenna accommodation room to retain the antenna device removed from the antenna attaching tool, and the housing cover is configured to cover the antenna accommodation room in an openable or closable manner and include a door that can be locked in a state where the antenna accommodation room is closed.

According to the aspect of the present invention, the antenna device can be accommodated in the antenna accommodation room in a state where the cable is being connected to the antenna device and can be attached to the vehicle body in a state where the cable is being connected to the antenna device. It is possible to enhance the workability on the work of removing the antenna device from the vehicle body for the storage and the work of attaching the stored antenna device to the vehicle body.

MODE FOR CARRYING OUT THE INVENTION

Figure 1:
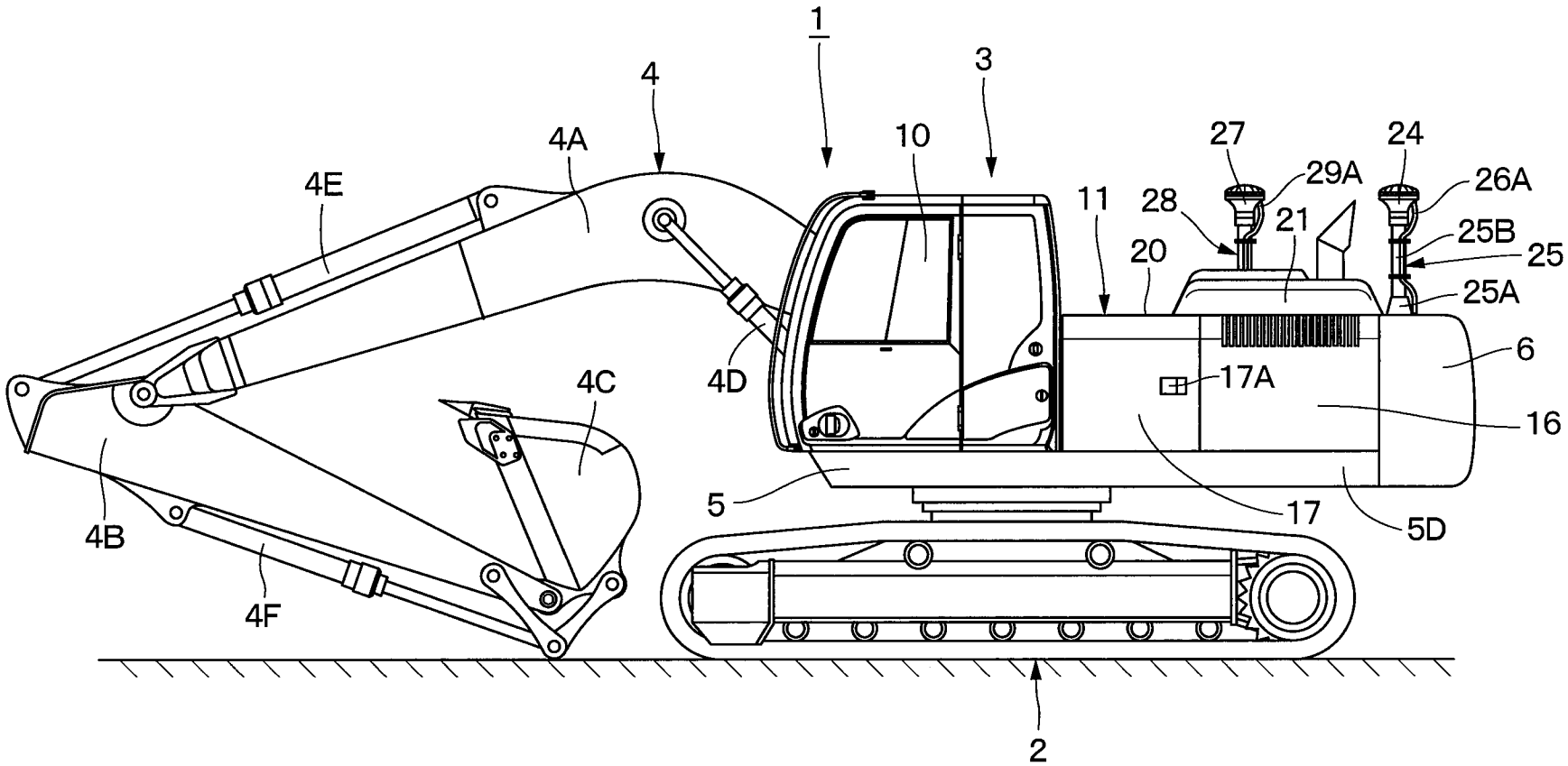
FIG. 1 is a left side view showing a hydraulic excavator according to an embodiment of the present invention.

Hereinafter, a construction machine according to embodiments of the present invention will be in detail explained referring to FIG. 1 to FIG. 12 by taking a case of being applied to a hydraulic excavator as an example. It should be noted that an explanation will be made of the embodiments by defining a traveling direction of the hydraulic excavator as a front-rear direction and a direction perpendicular to the traveling direction of the hydraulic excavator as a left-right direction.

FIG. 1 to FIG. 10 show a first embodiment of the present invention. A hydraulic excavator 1 representative of a construction machine includes an automotive lower traveling structure 2 of a crawler type in the front-rear direction, an upper revolving structure 3 mounted on the lower traveling structure 2 to be capable of revolving thereto, and a working mechanism 4 disposed on the front side of the upper revolving structure 3. The lower traveling structure 2 and the upper revolving structure 3 configure a vehicle body of the hydraulic excavator 1. The hydraulic excavator 1 travels at a working site by the lower traveling structure 2 and carries out an excavating work of earth and sand or the like by tilting and lifting the working mechanism 4 while revolving the upper revolving structure 3.

The working mechanism 4 includes a boom 4A attached on the front side of a revolving frame 5 to be described later to be capable of tilting and lifting thereto, an arm 4B rotatably attached on the tip end of the boom 4A, and a bucket 4C rotatably attached on the tip end of the arm 4B. In addition, the working mechanism 4 is provided with boom cylinders 4D for driving the boom 4A, an arm cylinder 4E for driving the arm 4B, and a bucket cylinder 4F for driving the bucket 4C.

The upper revolving structure 3 is disposed on the lower traveling structure 2 to be capable of revolving thereto. The upper revolving structure 3 includes the revolving frame 5, a counterweight 6, an engine 7, a cab 10, a housing cover 11, an operating oil tank 22, and a fuel tank 23, which will be described later, and the like.

The revolving frame 5 as a vehicle body frame is configured as a base of the upper revolving structure 3. The revolving frame 5 includes a bottom plate 5A, a left vertical plate 5B and a right vertical plate 5C, and a left side frame 5D, and a right side frame 5E. The left vertical plate 5B and the right vertical plate 5C are arranged to rise upwards on the bottom plate 5A and extend in the front-rear direction with a certain clearance in the left-right direction therebetween.

The left side frame 5D and the right side frame 5E are respectively arranged in both sides of the bottom plate 5A in the left-right direction and extend in the front-rear direction. Base ends of the boom 4A and the boom cylinders 4D are rotatably attached on the front sides of the left vertical plate 5B and the right vertical plate 5C.

The counterweight 6 is disposed on the rear end side of the revolving frame 5. The counterweight 6 is formed as a heavy load with the rear surface in an arc shape and acts as a weight balance to the working mechanism 4.

The engine 7 as a prime mover is positioned in front of the counterweight 6 and is mounted on the rear side of the revolving frame 5. The engine 7 extends in the left-right direction to be disposed in a transverse state. A hydraulic pump 8 is attached on the right side to the engine 7. The hydraulic pump 8 is driven by the engine 7 to discharge the operating oil stored in the operating oil tank 22 to hydraulic actuators for a traveling motor of the lower traveling structure 2, a revolving motor (not shown) of the upper revolving structure 3, the respective cylinders 4D, 4E, 4F of the working mechanism 4, and the like. It should be noted that the prime mover may include an electric motor or a hybrid prime mover composed of a combination of an engine and an electric motor.

A heat exchanger 9 is positioned on the left side to the engine 7 to be mounted on the revolving frame 5. The heat exchanger 9 includes a radiator for cooling engine-cooling water, an oil cooler for cooling operating oil, and the like. The heat exchanger 9 receives supply of cooling wind (arrow F in FIG. 3) introduced into the inside of the housing cover 11 by a cooling fan 7A to release heat of the engine-cooling water, the operating water and the like into the cooling wind.

The cab 10 is positioned on the left side from the left vertical plate 5B of the revolving frame 5 to be disposed on the left front side of the revolving frame 5. The cab 10 is formed in a boxy shape to define an operator's room, and an operator's seat (not shown) for an operator to sit on is disposed inside the cab 10. In addition, a travelling lever and pedal device (not shown) for controlling a travelling operation of the hydraulic excavator 1 is disposed in front of the operator's seat, and control lever devices (not shown) for controlling a revolving operation of the upper revolving structure 3 and an operation of the working mechanism 4 are respectively arranged in both sides of the operator's seat in the left-right direction.

The housing cover 11 is positioned in front of the counterweight 6 to be disposed on the revolving frame 5. The housing cover 11 is configured to be supported by a left support member 15 and a right support member 18, which will be described later, arranged on the revolving frame 5, and the like, and include a left rear side door 16, a left front side door 17, a right side door 19, an upper surface cover 20, and an engine cover 21.

The housing cover 11 covers mounted equipment composed of the engine 7, the hydraulic pump 8, the heat exchanger 9 and the like, which are mounted on the revolving frame 5. A prime mover room (not shown) for accommodating the engine 7, a heat exchanger room 12 for accommodating the heat exchanger 9 and a pump room 13 for accommodating the hydraulic pump 8 are formed in the inside of the housing cover 11. In addition, a partition member (fire wall) 14 for the partitioning between the prime mover room and the pump room 13 is disposed in the inside of the housing cover 11 (refer to FIG. 10).

Figure 4:
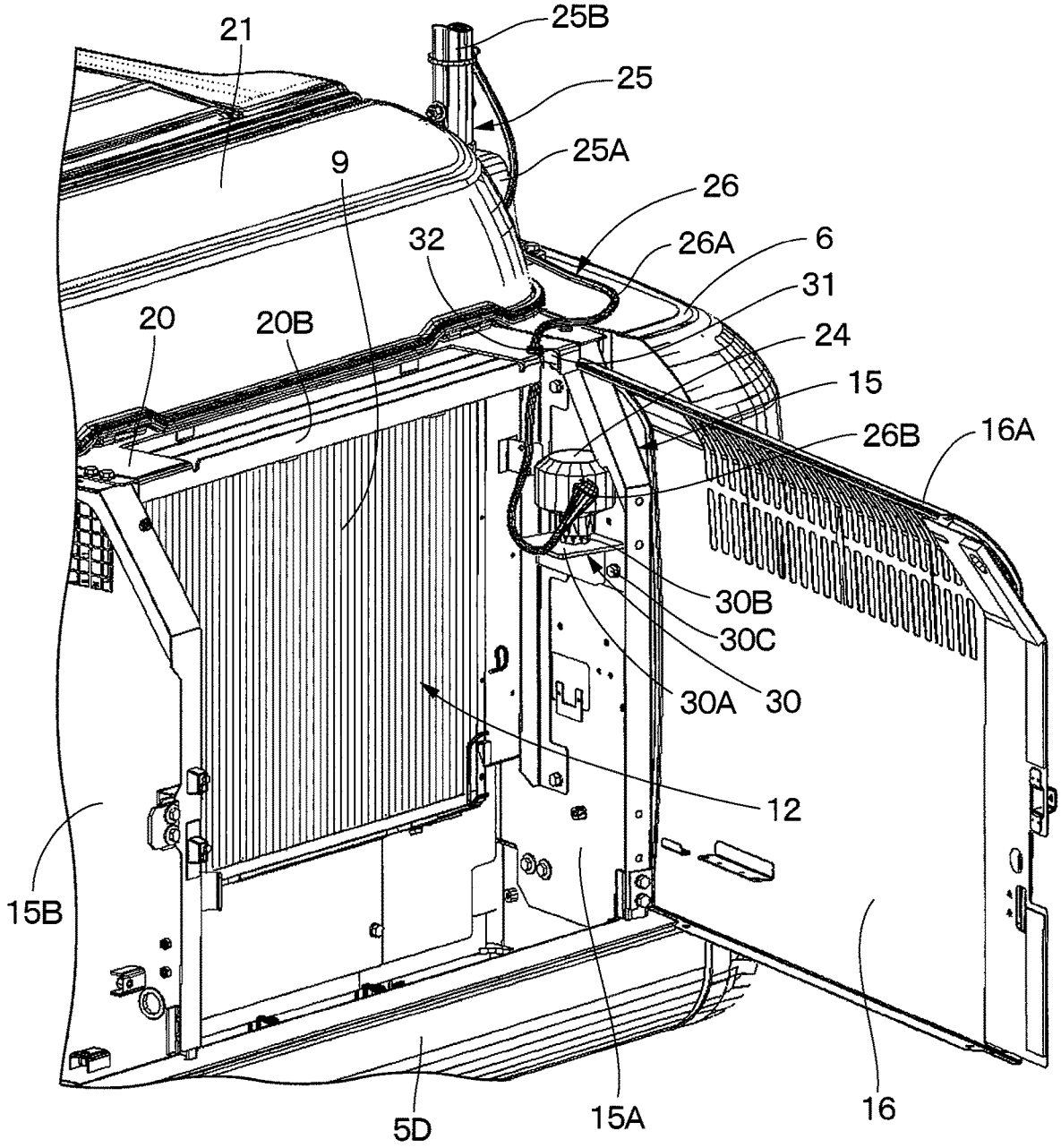
FIG. 4 is a perspective view showing a state where a first antenna device is accommodated in a heat exchanger room.

As shown in FIG. 4, the left support member 15 includes a plurality of left support members, which are arranged to rise upwards on the left side of the revolving frame 5 with intervals therebetween in the front-rear direction. The left support member 15 includes a left rear support member 15A disposed adjacent to the counterweight 6 on the left front side, a left intermediate support member 15B disposed in front of the left rear support member 15A and a left front support member (not shown) disposed in front of the left intermediate support member 15B.

The left rear side door 16 configuring part of the housing cover 11 is supported via a hinge mechanism (not shown) on the left rear support member 15A. The left rear side door 16 rotates in the front-rear direction and in the left-right direction (in the horizontal direction) on a basis of the hinge mechanism to cover the heat exchanger room 12 from the left side in an openable or closable manner. That is, the left rear side door 16 rotationally moves between an open position (position in FIG. 4) of opening the heat exchanger room 12 and a closed position of closing the heat exchanger room 12.

The left front side door 17 is supported via a hinge mechanism on a left front support member (neither of them is shown) to be rotatable in the front-rear direction and in the left-right direction (in the horizontal direction). The left front side door 17 covers a utility room (not shown) disposed in front of the heat exchanger room 12 from the left lateral side in an openable or closable manner. The left front side door 17 is provided with a locking mechanism 17A. The left front side door 17 is retained in the closed position by locking the locking mechanism 17A. Here, in a state (state in FIG. 1) where the left front side door 17 and the left rear side door 16 both are in the closed position, a rear end side of the left front side door 17 overlaps with a front end side of the left rear side door 16. Therefore, in the state where the left front side door 17 and the left rear side door 16 both are in the closed position, the left rear side door 16 cannot open as long as the locking mechanism 17A of the left front side door 17 is locked. Accordingly, the left rear side door 16 is locked in the closed position by the locking mechanism 17A of the left front side door 17.

Figure 10:
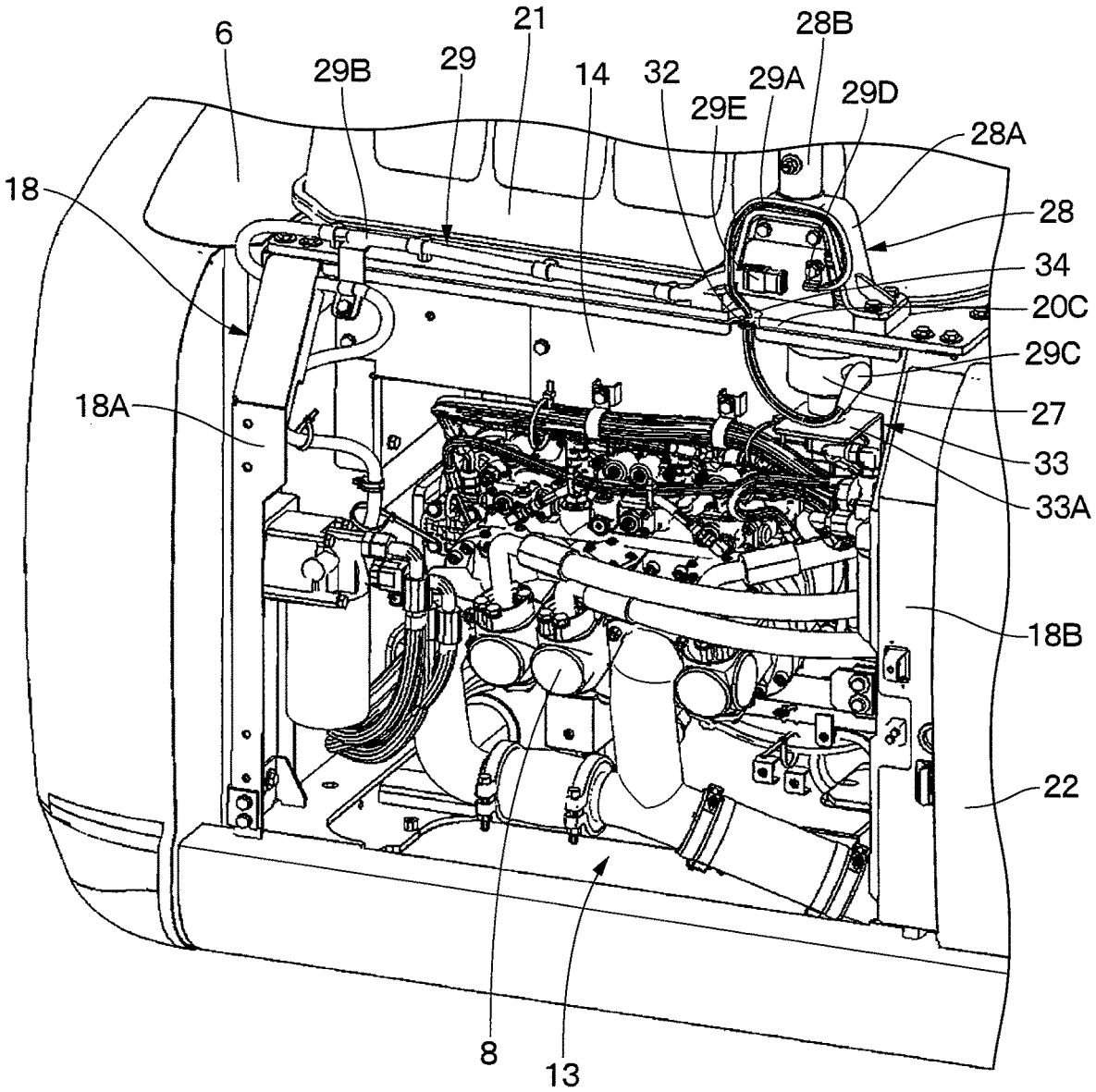
FIG. 10 is a perspective view showing a state where a second antenna device is accommodated in a pump room.

As shown in FIG. 10, the right support member 18 includes a plurality of right support members, which are arranged to rise upwards on the right side of the revolving frame 5 with intervals therebetween in the front-rear direction. The right support member 18 includes a right rear support member 18A disposed adjacent to the counterweight 6 on the right front side, and a right front support member 18B disposed in front of the right rear support member 18A.

The right side door 19 configuring part of the housing cover 11 is supported via a hinge mechanism (not shown) on the right rear support member 18A. The right side door 19 rotates in the front-rear direction and in the left-right direction (in the horizontal direction) on a basis of the hinge mechanism to cover the pump room 13 from the right lateral side in an openable or closable manner. That is, the right side door 19 rotationally moves between an open position of opening the pump room 13 and a closed position of closing the pump room 13. The right side door 19 is retained in the closed position by locking a locking mechanism 19A.

The upper surface cover 20 extends in a horizontal direction between upper ends of the left rear side door 16 and the left front side door 17 and an upper end of the right side door 19. An access opening (not shown) is formed in the upper surface cover 20 to be positioned above the engine 7, and a maintenance work to the engine 7 or the like is carried out through this access opening.

The engine cover 21 as a prime mover cover is disposed on the upper surface cover 20 in a state of covering the engine 7 from the upper side. The engine cover 21 extends in the left-right direction in a state of being raised upwards from the upper surface cover 20 to close the access opening formed in the upper surface cover 20. The engine cover 21 has a rear end that is attached via a hinge mechanism to a support member (neither of them is shown) and a front end that rotates in the upper-lower direction on a basis of the hinge mechanism. This configuration causes the engine cover 21 to be openable and closable to the upper surface cover 20 between the open position for opening the access opening and the closed position for closing the access opening. A part, which is closer to the front side than the engine cover 21, of the upper surface cover 20 acts as a working foothold 20A. The working foothold 20A is formed as a working foothold when a worker opens the engine cover 21 to carry out a maintenance work to the engine 7 or the like.

The operating oil tank 22 is disposed on the revolving frame 5 to be positioned on the right side from the right vertical plate 5C of the revolving frame 5 and in front of the hydraulic pump 8. The operating oil tank 22 reserves therein operating oil to be supplied to the hydraulic actuators for the traveling motor of the lower traveling structure 2, the revolving motor of the upper revolving structure 3, the respective cylinders 4D, 4E, 4F of the working mechanism 4, and the like. An upper surface of the operating oil tank 22 becomes a flat surface flush with the upper surface cover 20.

The fuel tank 23 is disposed on the right side from the right vertical plate 5C of the revolving frame 5 and to be adjacent to the front side of the operating oil tank 22. The fuel tank 23 reserves therein fuel to be supplied to the engine 7. An upper surface of the fuel tank 23 becomes a flat surface flush with the upper surface cover 20.

Next, an explanation will be made of a first antenna device 24 and a second antenna device 27 to be mounted on the upper revolving structure 3.

The first antenna device 24 is disposed on one side of the upper revolving structure 3 in the left-right direction, specifically on the left side to the counterweight 6. The second antenna device 27 is disposed on the other side of the upper revolving structure 3 in the left-right direction, specifically on the right front side of the upper surface cover 20 positioned above the pump room 13. The first and second antenna devices 24, 27 each are configured of a GNSS antenna, for example, and are connected to a controller (not shown) disposed in the inside of the housing cover 11.

The first antenna device 24 is removably attached to a first antenna attaching tool 25 fixed on the counterweight 6. The first antenna attaching tool 25 is provided with a fixing base 25A fixed on the upper surface of the counterweight 6 and a bar-shaped support mast 25B extending vertically upwards from the fixing base 25A. A fitting hole 24A is formed on the lower side of the first antenna device 24 to extend in the upper-lower direction (refer to FIG. 6). The first antenna device 24 is fixed using bolts or the like in a state where the fitting hole 24A is fitted to a tip end of the first antenna attaching tool 25 (support mast 25B).

A first cable 26 establishes the electrical connection between the controller disposed in the inside of the housing cover 11 and the first antenna device 24. The controller measures positional information of the hydraulic excavator 1 based on signals from the first antenna device 24 and the second antenna device 27 to control an operation of the hydraulic excavator 1.

Here, the first cable 26 is configured of an antenna-side cable 26A connected to the first antenna device 24 and a controller-side cable (not shown) connected to the controller.

The antenna-side cable 26A is disposed outside the upper revolving structure 3, and the controller-side cable is disposed in the inside of the housing cover 11. One end 26B of the antenna-side cable 26A is removably connected to the first antenna device 24, and an antenna-side connector 26C is disposed in the other end of the antenna-side cable 26A (refer to FIG. 7). One end of the controller-side cable is connected to the controller, and the other end of the controller-side cable is connected to a controller-side connector (not shown) disposed on the upper surface cover 20. Accordingly, by connecting the antenna-side connector 26C disposed in the antenna-side cable 26A to the controller-side connector disposed on the upper surface cover 20, the electrical connection between the first antenna device 24 and the controller is established via the first cable 26.

On the other hand, the second antenna device 27 is removably attached to a second antenna attaching tool 28 fixed on the right front side of the upper surface cover 20 that is above the pump room 13. The second antenna attaching tool 28 is provided with a fixing base 28A fixed on the upper surface of the upper surface cover 20 and a bar-shaped support mast 28B extending vertically upwards from the fixing base 28A. A fitting hole (not shown) similar to the first antenna device 24 is formed on the lower side of the second antenna device 27. The second antenna device 27 is fixed using bolts or the like in a state where the fitting hole is fitted to a tip end of the support mast 28B.

A second cable 29 establishes the electrical connection between the controller (not shown) disposed in the inside of the housing cover 11 and the second antenna device 27. As shown in FIG. 10, the second cable 29 is configured of an antenna-side cable 29A connected to the second antenna device 27 and a controller-side cable 29B connected to the controller. The antenna-side cable 29A is disposed outside the upper revolving structure 3, and the controller-side cable 29B is mainly disposed inside the housing cover 11.

One end 29C of the antenna-side cable 29A is removably connected to the second antenna device 27, and an antenna-side connector 29D is disposed in the other end of the antenna-side cable 29A. One end of the controller-side cable 29B is connected to the controller, and a controller-side connector 29E is disposed in the other end of the controller-side cable 29B. The controller-side connector 29E is disposed on the upper surface cover 20 to be adjacent to the fixing base 28A of the second antenna attaching tool 28. Accordingly, by connecting the antenna-side connector 29D disposed in the antenna-side cable 29A to the controller-side connector 29E, the electrical connection between the second antenna device 27 and the controller is established via the second cable 29.

The first antenna accommodation room is formed by the heat exchanger room 12. As shown in FIG. 4, the heat exchanger room 12 accommodates therein the first antenna device 24 removed from the first antenna attaching tool 25 in a state where the antenna-side cable 26A of the first cable 26 is connected to the first antenna device 24. The heat exchanger room 12 is opened by opening the left rear side door 16, is closed by closing the left rear side door 16 and is locked by the locking mechanism 17A of the left front side door 17.

Figure 5:
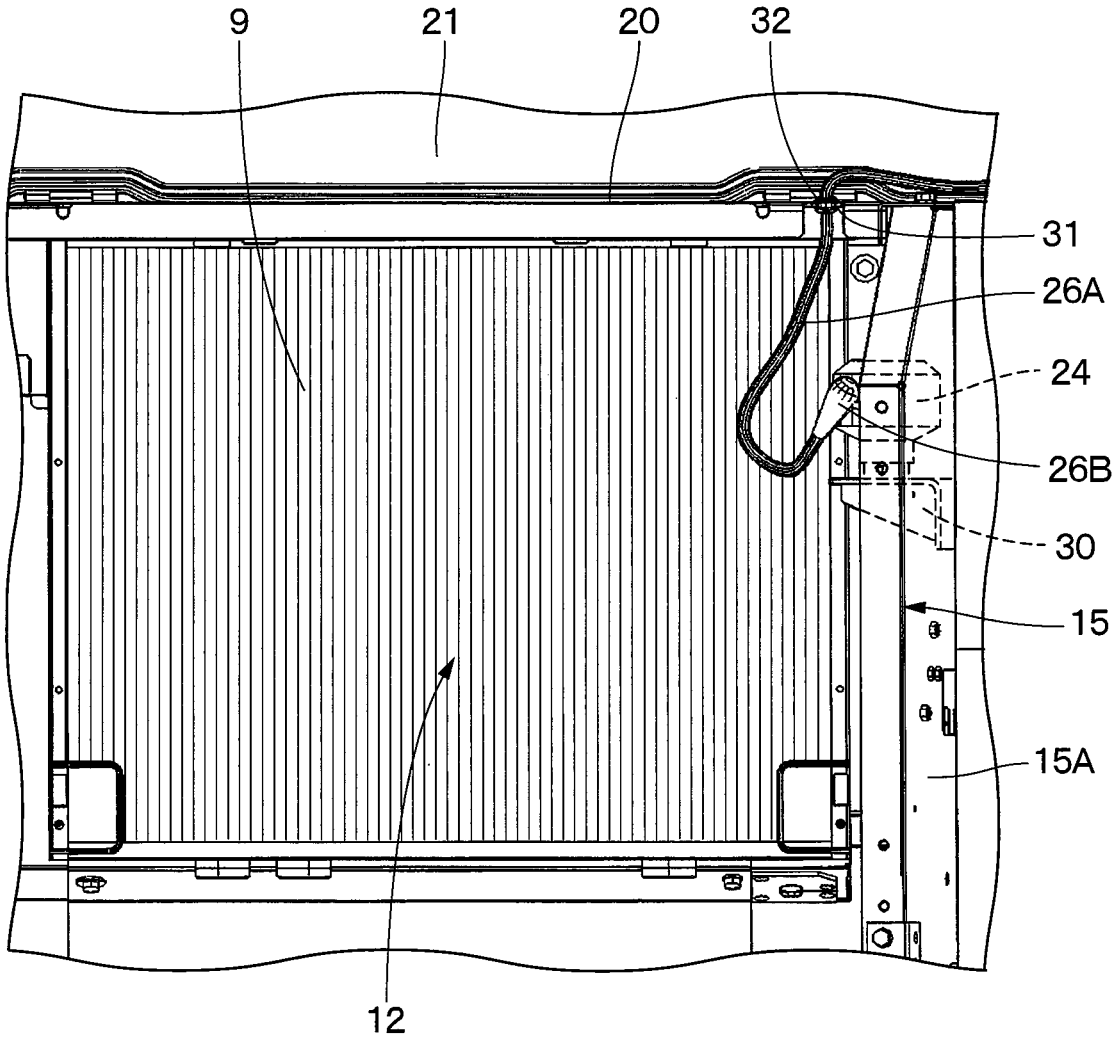
FIG. 5 is a left side view showing a state where the first antenna device is accommodated in the heat exchanger room with a left side door being removed, as viewed from a left lateral side.
Figure 6:
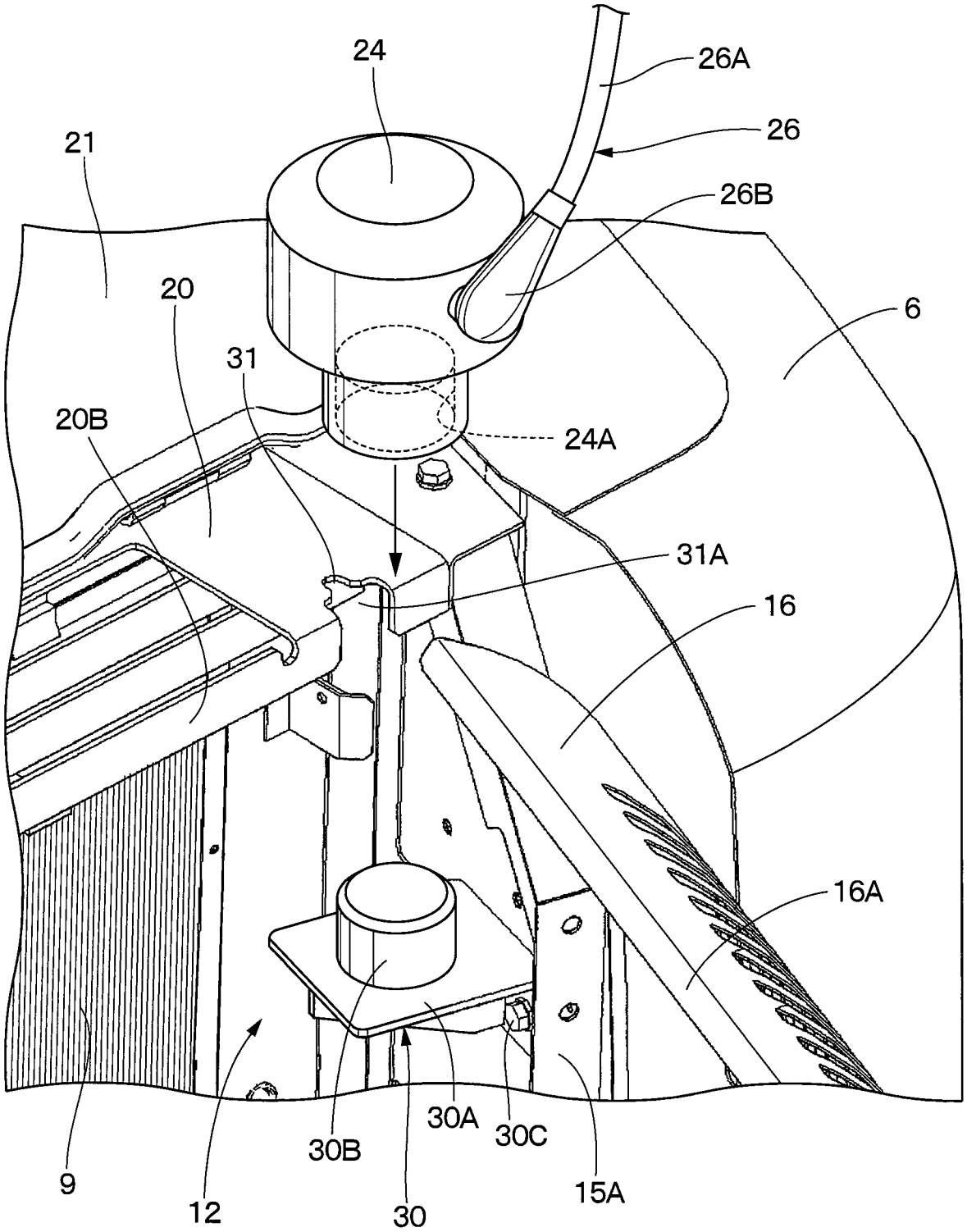
FIG. 6 is an exploded perspective view showing a state of retaining the first antenna device by a first antenna retaining tool.

A first antenna retaining tool 30 is disposed inside the heat exchanger room 12 as the first antenna accommodation room. As shown in FIG. 4 to FIG. 6, the first antenna retaining tool 30 is attached to the left rear support member 15A for supporting the left rear side door 16 and retains the first antenna device 24 removed from the first antenna attaching tool 25. The first antenna retaining tool 30 includes a base member 30A bent in an L-letter shape and a cylindrical protrusion member 30B disposed on the upper surface of the base member 30A to protrude vertically upwards. The protrusion member 30B has an outer diameter dimension equal to that of the support mast 25B of the first antenna attaching tool 25. The first antenna retaining tool 30 is disposed in the heat exchanger room 12 by fixing the base member 30A on an upper part of the left rear support member 15A with a bolt 30C. Accordingly, the first antenna device 24 can stably be retained in the heat exchanger room 12 by fitting the fitting hole 24A of the first antenna device 24 to the protrusion member 30B of the first antenna retaining tool 30.

Here, as shown in FIG. 5, the first antenna retaining tool 30 is disposed in a position where the first antenna device 24 does not overlap with the heat exchanger 9 in a flowing direction (in the left-right direction as shown by an arrow F in FIG. 3) of cooling wind to be supplied to the heat exchanger 9 in a state of retaining the first antenna device 24. As a result, even in a case where the first antenna device 24 is retained in the heat exchanger room 12 by the first antenna retaining tool 30, the cooling wind to be supplied to the heat exchanger 9 is prevented from being interrupted by the first antenna device 24, making it possible to sufficiently supply the cooling wind to the heat exchanger 9.

A notch groove 31 as a cable insert part is disposed on the side of a left end edge 20B of the upper surface cover 20. Upon accommodating the first antenna device 24 into the heat exchanger room 12, the first cable 26 (antenna-side cable 26A) connected to the first antenna device 24 is inserted in the notch groove 31. Thereby, in a state where the antenna-side cable 26A is connected to the first antenna device 24, the first antenna device 24 can be accommodated into the heat exchanger room 12. As shown in FIG. 6, in a state where the left rear side door 16 is closed, the notch groove 31 has a part where the upper surface cover 20 abuts on a upper end edge 16A of the left rear side door 16, that is, a wide opening end 31A that is open to the left end edge 20B of the upper surface cover 20. The antenna-side cable 26A is smoothly guided through the opening end 31A into the notch groove 31.

Figure 7:
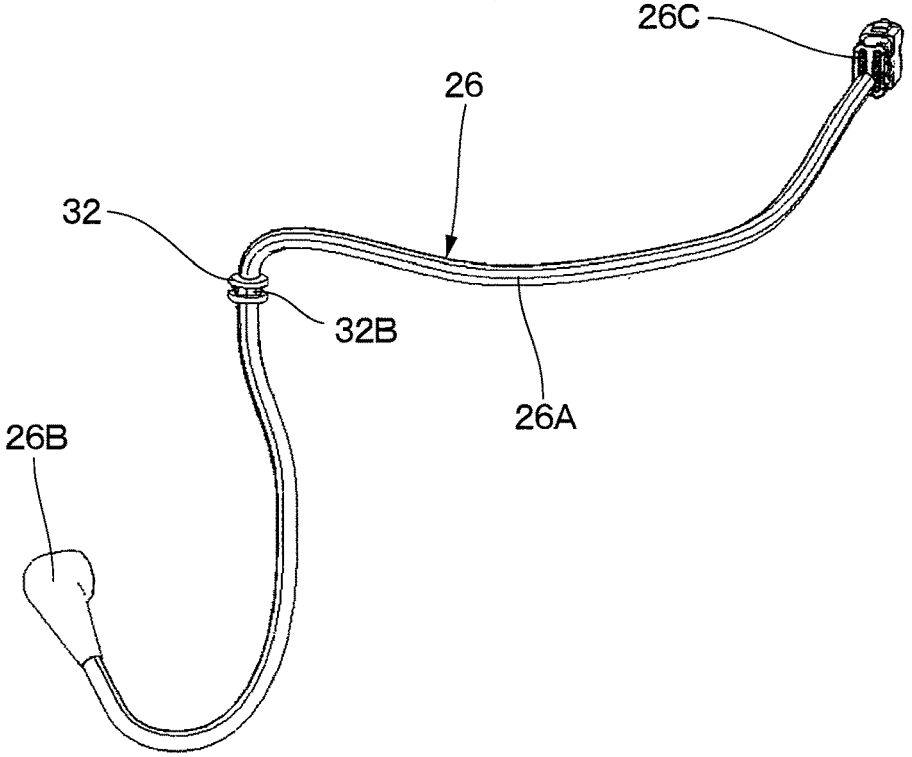
FIG. 7 is a perspective view showing an antenna-side cable to which an annular cable protection tool is attached.
Figure 8:
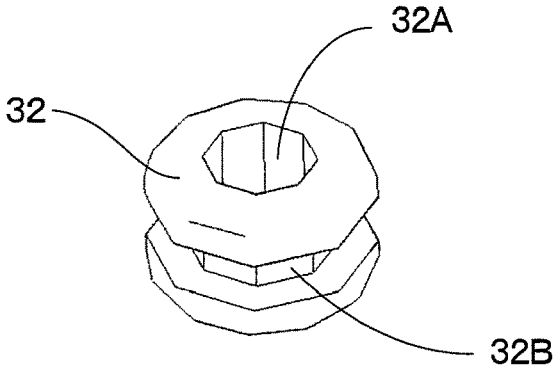
FIG. 8 is a perspective view showing the annular cable protection tool as a single unit.

A cable protection tool 32 is disposed between the antenna-side cable 26A of the first cable 26 and the notch groove 31 in a state where the first antenna device 24 is retained by the first antenna retaining tool 30. As shown in FIG. 7 and FIG. 8, the cable protection tool 32 is composed of an annular body to be attached on the antenna-side cable 26A and is formed using an elastic material such as rubber. A cable insert bore 32A is formed on an inner peripheral side of the cable protection tool 32, and the antenna-side cable 26A is axially inserted in the cable insert bore 32A. A small-diameter narrow part 32B is formed on an outer peripheral side of the cable protection tool 32, and the narrow part 32B is engaged to the notch groove 31 of the upper surface cover 20.

Figure 9:
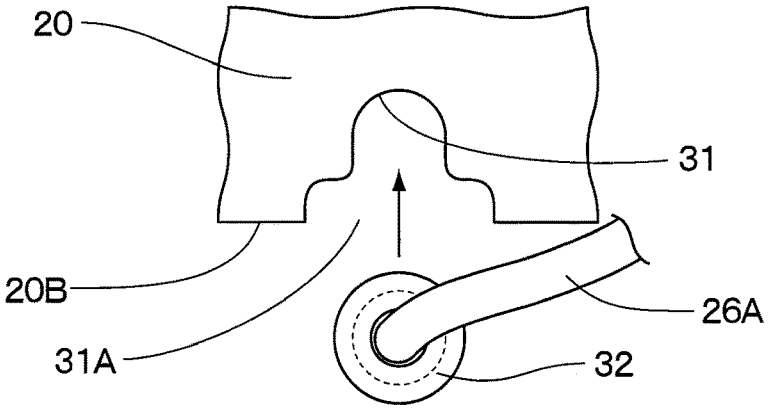
FIG. 9 is a plan view showing a state where the annular cable protection tool is inserted in a notch groove of a housing cover as viewed from above.

That is, the cable protection tool 32 is in advance attached on the antenna-side cable 26A, and in a state where the first antenna device 24 is retained by the first antenna retaining tool 30, as shown in FIG. 9 the cable protection tool 32 attached on the antenna-side cable 26A is caused to be engaged to the notch groove 31 of the upper surface cover 20. As a result, the antenna-side cable 26A can be prevented from rubbing against the notch groove 31 to be damaged, thus protecting the antenna-side cable 26A.

The second antenna accommodation room is formed by the pump room 13. As shown in FIG. 10, the pump room 13 accommodates therein the second antenna device 27 removed from the second antenna attaching tool 28 in a state where the antenna-side cable 29A of the second cable 29 is connected to the second antenna device 27. The pump room 13 is opened by opening the right side door 19, is closed by closing the right side door 19 and is locked by the locking mechanism 19A.

A second antenna retaining tool 33 is disposed inside the pump room 13 as the second antenna accommodation room. As shown in FIG. 10, the second antenna retaining tool 33 is attached to the partition member 14 for the partitioning between the engine room and the pump room 13 and retains the second antenna device 27 removed from the second antenna attaching tool 28. The second antenna retaining tool 33 includes, as similar to the first antenna retaining tool 30, a base member 33A fixed on the partition member 14 using a bolt and a protrusion member (not shown) disposed on the base member 33A. In addition, the second antenna device 27 can stably be retained in the pump room 13 by fitting a fitting hole (not shown) of the second antenna device 27 to the protrusion member of the second antenna retaining tool 33.

A notch groove 34 as a cable insert part is disposed on the side of a right end edge 20C of the upper surface cover 20. Upon accommodating the second antenna device 27 inside the pump room 13, the second cable 29 (antenna-side cable 29A) connected to the second antenna device 27 is inserted in the notch groove 34. Thereby, in a state where the antenna-side cable 29A is connected to the second antenna device 27, the second antenna device 27 can be accommodated inside the pump room 13. In a state where the right side door 19 is closed, the notch groove 34 has a part where the upper surface cover 20 abuts on a upper end edge 19B of the right side door 19, that is, an opening end 34A that is open to the right end edge 20C of the upper surface cover 20. The antenna-side cable 29A is smoothly guided through the opening end 34A into the notch groove 34.

The cable protection tool 32 is disposed between the antenna-side cable 29A of the second cable 29 and the notch groove 34. The cable protection tool 32 is in advance attached on the antenna-side cable 29A, and in a state where the second antenna device 27 is retained by the second antenna retaining tool 33, the cable protection tool 32 attached on the antenna-side cable 29A is caused to be engaged to the notch groove 34 of the upper surface cover 20. As a result, the antenna-side cable 29A can be prevented from rubbing against the notch groove 34 to be damaged, thus protecting the antenna-side cable 29A.

The hydraulic excavator 1 according to the present embodiment has the configuration as described above, and hereinafter, an explanation will be made of an operation of the hydraulic excavator 1.

Figure 2:
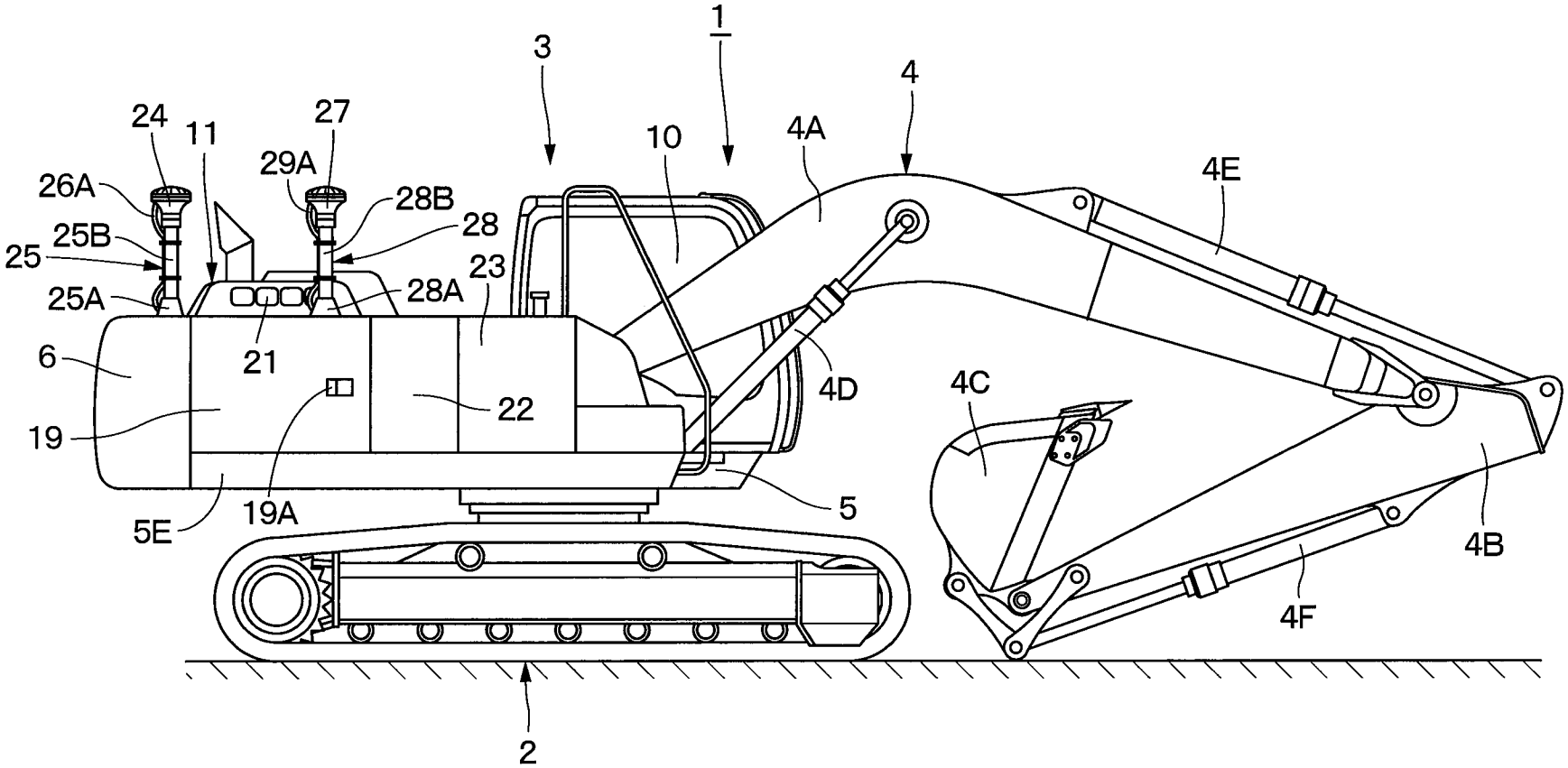
FIG. 2 is a right side view showing the hydraulic excavator.
Figure 3:
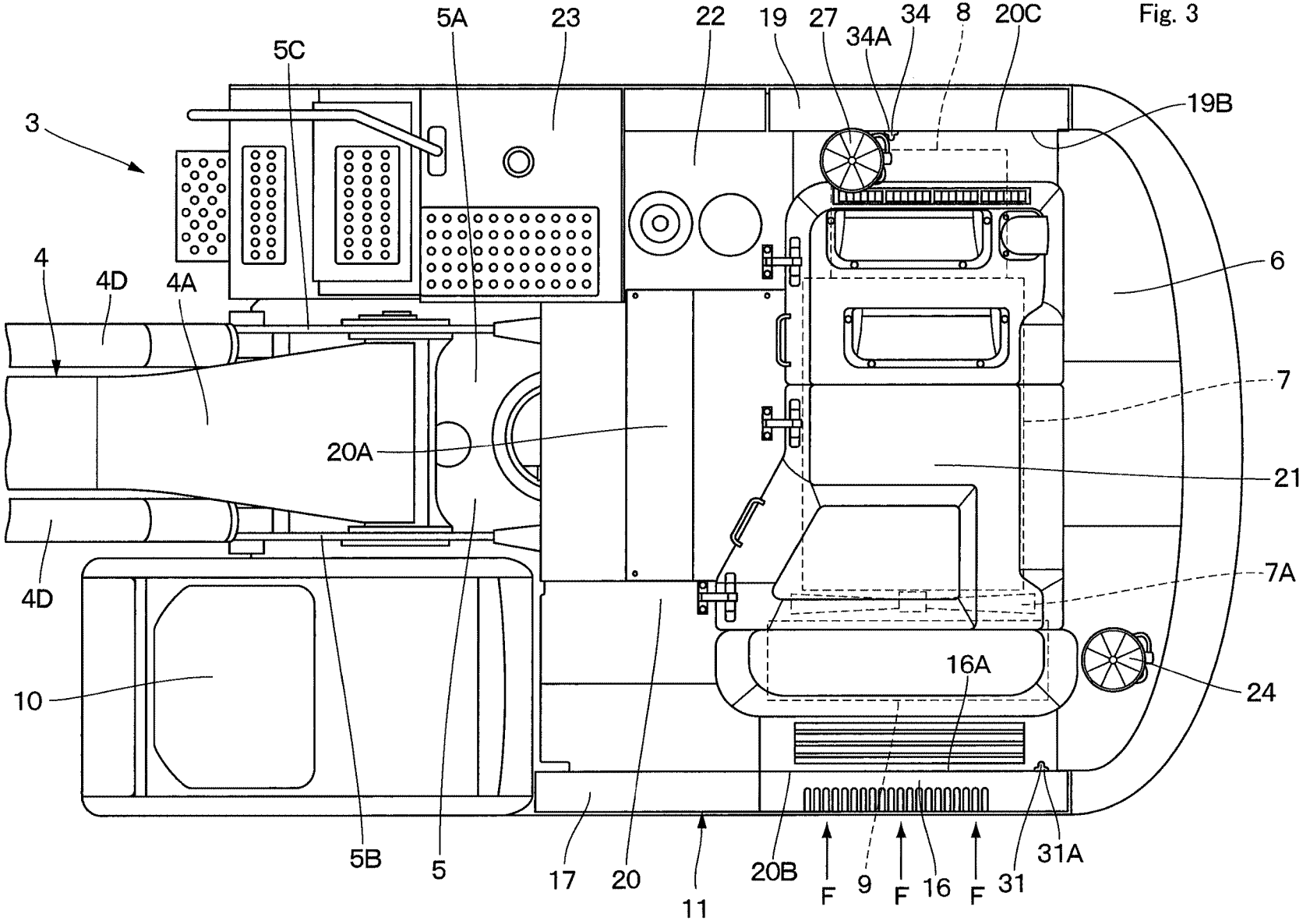
FIG. 3 is a plan view showing the hydraulic excavator as viewed from above.

In a case where the positional information of the hydraulic excavator 1 becomes necessary at the working of the hydraulic excavator 1, as shown in FIG. 1 to FIG. 3 the first antenna device 24 is attached to the first antenna attaching tool 25 and the second antenna device 27 is attached to the second antenna attaching tool 28. In this way, in a state where the first and second antenna devices 24, 27 are attached to the upper revolving structure 3, an operator gets in the cab sits on the operator's seat (not shown), and starts with the engine 7. In this state, by operating the traveling lever and pedal device (not shown), it is possible to cause the hydraulic excavator 1 to travel toward a working site. In addition, by controlling the control lever device (not shown), the hydraulic excavator 1 can carry out the excavating work or the like using the working mechanism 4 while revolving the upper revolving structure 3.

At the excavating work using the working mechanism 4, the first and second antenna devices 24, 27 receive the positional information of the hydraulic excavator 1 from a satellite and transmit this positional information to the controller (not shown). The controller measures the positional information of the hydraulic excavator 1 based upon the positional information from the first and second antenna devices 24, 27. In addition, the controller compares the positional information of the hydraulic excavator 1 and positional information on the tip end of the working mechanism 4 obtained from a sensor attached on the working mechanism 4 with terrain data or target terrain data to make calculation for construction to a target terrain, for example, causing the construction information (calculation result) to be displayed on a monitor in the cab 10. Thereby, an operator confirms the construction information displayed on the monitor, while controlling the operation of the working mechanism 4 using the control lever device, thus making it possible to carry out the construction to the target terrain.

Next, when the operation of the hydraulic excavator 1 is stopped, the first and second antenna devices 24, 27 are removed from the upper revolving structure 3 for a protection against theft. First, the first antenna device 24 is removed from the support mast 25B of the first antenna attaching tool 25 in a state where the one end 26B of the antenna-side cable 26A is being connected to the first antenna device 24.

On the other hand, the locking mechanism 17A of the left front side door 17 is unlocked and the left front side door 17 and the left rear side door 16 are moved to the open position. Thereby, the heat exchanger room 12 is opened to cause the first antenna retaining tool 30 to appear. Next, as shown in FIG. 6, the fitting hole 24A of the first antenna device 24 removed from the first antenna attaching tool 25 is caused to be fitted to the protrusion member 30B of the first antenna retaining tool 30. Thereby, the first antenna device 24 can stably be retained in the heat exchanger room 12 by the first antenna retaining tool 30.

On the other hand, the middle part of the antenna-side cable 26A connected to the first antenna device 24 is inserted in the notch groove 31 formed in the left end edge 20B of the upper surface cover 20. As a result, without placing the antenna-side cable 26A between the left end edge 20B of the upper surface cover 20 and the left rear side door 16, the left rear side door 16 is moved to the closed position, making it possible to close the heat exchanger room 12. At this time, since the cable protection tool 32 is attached to the middle part of the antenna-side cable 26A, as shown in FIG. 9 the narrow part 32B of the cable protection tool 32 is engaged to the notch groove 31. Thereby, in a state where the antenna-side cable 26A is prevented from rubbing against the notch groove 31 of the upper surface cover 20, the antenna-side cable 26A can be positioned to the upper surface cover 20.

Next, the left rear side door 16 is moved to the closed position and the left front side door 17 is moved to the closed position, and the locking mechanism 17A of the left front side door 17 is locked. Thereby, the first antenna device 24 retained by the first antenna retaining tool 30 can be accommodated in the heat exchanger room 12 closed by the locked left rear side door 16. Accordingly, at the working without using the first antenna device 24, the first antenna device 24 can be prevented from being damaged by flying stones and from being stolen.

In this case, as shown in FIG. 5, the first antenna retaining tool 30 is disposed in the position where the first antenna device 24 does not overlap with the heat exchanger 9 in the flowing direction (in the left-right direction) of the cooling wind to be supplied to the heat exchanger 9 at the time of retaining the first antenna device 24. Therefore, in a case of operating the hydraulic excavator 1 in a state where the first antenna device 24 is being accommodated in the heat exchanger room 12, the cooling wind to be supplied to the heat exchanger 9 can be prevented from being interrupted by the first antenna device 24, sufficiently supplying the cooling wind to the heat exchanger 9.

Next, at the time of removing the second antenna device 27, the second antenna device 27 is removed from the support mast 28B of the second antenna attaching tool 28 while the one end 29C of the antenna-side cable 29A is connected to the second antenna device 27.

On the other hand, the locking mechanism 19A of the right side door 19 is unlocked and the right side door 19 is moved to the open position. Thereby, as shown in FIG. 10, the pump room 13 is opened to cause the second antenna retaining tool 33 to appear. Next, the second antenna device 27 removed from the second antenna attaching tool 28 is caused to be fitted to the protrusion member (not shown) of the second antenna retaining tool 33. Thereby, the second antenna device 27 can stably be retained in the pump room 13 by the second antenna retaining tool 33.

On the other hand, the middle part of the antenna-side cable 29A connected to the second antenna device 27 is inserted in the notch groove 34 formed in the right end edge 20C of the upper surface cover 20. As a result, without placing the antenna-side cable 29A between the right end edge 20C of the upper surface cover 20 and the right side door 19, the right side door 19 is moved to the closed position, making it possible to close the pump room 13. At this time, the cable protection tool 32 attached to the middle part of the antenna-side cable 29A is engaged to the notch groove 34. Thereby, in a state where the antenna-side cable 29A is prevented from rubbing against the notch groove 34 of the upper surface cover 20, the antenna-side cable 29A can be positioned to the upper surface cover 20.

Next, in a state where the right side door 19 is moved to the closed position, the locking mechanism 19A of the right side door 19 is locked. Thereby, the second antenna device 27 retained by the second antenna retaining tool 33 can be accommodated in the pump room 13 closed by the locked right side door 19. Accordingly, at the working without using the second antenna device 27, the second antenna device 27 can be prevented from being damaged by flying stones and from being stolen.

In this way, according to the hydraulic excavator 1 by the present embodiment, in a state where the antenna-side cable 26A is connected to the first antenna device 24, the first antenna device 24 can be removed from the first antenna attaching tool 25 to be accommodated in the heat exchanger room 12 and the first antenna device 24 can be taken out from the heat exchanger room 12 to be attached to the first antenna attaching tool 25. Similarly, in a state where the antenna-side cable 29A is connected to the second antenna device 27, the second antenna device 27 can be removed from the second antenna attaching tool 28 to be accommodated in the pump room 13 and the second antenna device 27 can be taken out from the pump room 13 to be attached to the second antenna attaching tool 28.

Accordingly, upon attaching and removing the first antenna device 24 to and from the first antenna attaching tool the work of connecting the antenna-side cable 26A to the first antenna device 24 and the work of removing the antenna-side cable 26A from the first antenna device 24 become unnecessary. Similarly, upon attaching and removing the second antenna device 27 to and from the second antenna attaching tool 28, the work of connecting the antenna-side cable 29A to the second antenna device 27 and the work of removing the antenna-side cable 29A from the second antenna device 27 become unnecessary. As a result, it is possible to enhance the workability at the time of removing the first and second antenna devices 24, 27 from the first and second antenna attaching tools 25, 28 to be stored in the heat exchanger room 12 and the pump room 13 and the workability at the time of attaching the stored first and second antenna devices 24, 27 to the first and second antenna attaching tools 25, 28.

Figure 11:
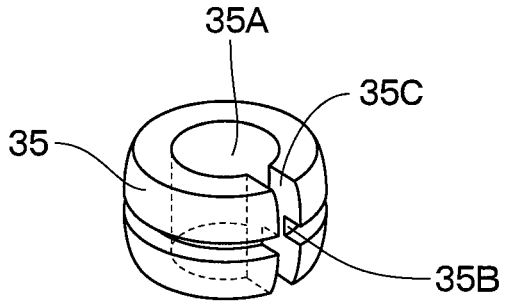
FIG. 11 is a perspective view showing a cable protection tool in a C-letter shape according to a second embodiment as a single unit.
Figure 12:
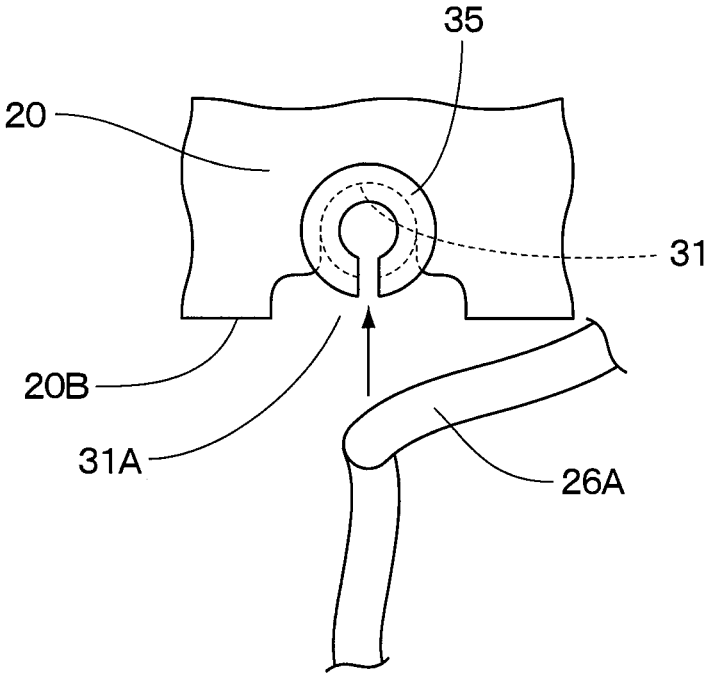
FIG. 12 is a plan view showing a state where the antenna-side cable is inserted in the cable protection tool in the C-letter shape attached in the notch groove of the housing cover as viewed from above.

Next, FIG. 11 and FIG. 12 show a cable protection tool according to a second embodiment. The cable protection tool is used in the present embodiment instead of the cable protection tool 32 according to the first embodiment.

The cable protection tools 35 are disposed respectively between the antenna-side cable 26A connected to the first antenna device 24 and the notch groove 31 of the upper surface cover 20 and between the antenna-side cable 29A connected to the second antenna device 27 and the notch groove 34 of the upper surface cover 20. The cable protection tool 35 is composed of a C-letter shaped body to be attached on each of the notch grooves 31, 34 and is formed using an elastic material such as rubber. That is, the cable protection tool 35 is formed in a C-letter shape as a whole by radially disposing a notch part 35C to an annular body composed of a cable insert bore 35A formed on the inner peripheral side and a narrow part 35B formed on the outer peripheral side.

The cable protection tool 35 is in advance attached to the notch groove 31 of the upper surface cover 20 by engaging the narrow part 35B to the notch groove 31. Therefore, upon accommodating the first antenna device 24 in the heat exchanger room 12, the middle part of the antenna-side cable 26A connected to the first antenna device 24 can laterally be inserted through the notch part 35C in the cable insert bore 35A of the cable protection tool 35 in advance attached to the notch groove 31 (refer to FIG. 12). Similarly, upon accommodating the second antenna device 27 in the pump room 13, the middle part of the antenna-side cable 29A connected to the second antenna device 27 can laterally be inserted through the notch part 35C in the cable insert bore 35A of the cable protection tool 35 in advance attached to the notch groove 34.

In this way, by using the cable protection tool 35 in the C-letter shape according to the second embodiment, it is possible to enhance the workability at the time of disposing the cable protection tool 35 between the antenna-side cable 26A and the notch groove 31 and at the time of disposing the cable protection tool 35 between the antenna-side cable 29A and the notch groove 34.

Thus, in the present embodiment the upper revolving structure 3 of the hydraulic excavator 1 includes the antenna accommodation rooms (the heat exchanger room 12 and the pump room 13) that are disposed in the inside of the housing cover 11 to accommodate the first and second antenna devices 24, 27 removed from the first and second antenna attaching tools 25, 28 in a state where the antenna-side cables 26A, 29A are connected to the first and second antenna devices 24, 27, and the first and second antenna retaining tools 30, 33 that are disposed in the heat exchanger room 12 and the pump room 13 to retain the first and second antenna devices 24, 27 removed from the first and second antenna attaching tools 25, 28, and the housing cover 11 is configured to cover the heat exchanger room 12 and the pump room 13 in an openable or closable manner and include the left rear side door 16 and the right side door 19 that can be locked in a state where the heat exchanger room 12 and the pump room 13 are closed.

According to this configuration, the first antenna device 24, in a state where the antenna-side cable 26A is being connected to the first antenna device 24, can be removed from the first antenna attaching tool 25 to be accommodated in the heat exchanger room 12, and can also be removed from the heat exchanger room 12 to be attached to the first antenna attaching tool 25. In addition, the second antenna device 27, in a state where the antenna-side cable 29A is being connected to the second antenna device 27, can be removed from the second antenna attaching tool 28 to be accommodated in the pump room 13 and can also be taken out from the pump room 13 to be attached to the second antenna attaching tool 28. As a result, it is possible to enhance the workability at the time of removing the first and second antenna devices 24, 27 from the first and second antenna attaching tools 25, 28 to be stored in the heat exchanger room 12 and the pump room 13 and the workability at the time of attaching the stored first and second antenna devices 24, 27 to the first and second antenna attaching tools 25, 28.

In the embodiment, the upper surface cover 20 or the left rear side door 16 and the right side door 19 are provided with the cable insert parts (the notch grooves 31, 34), in which the antenna-side cables 26A, 29A are inserted when the first and second antenna devices 24, 27 are accommodated in the heat exchanger room 12 and the pump room 13. According to this configuration, the heat exchanger room 12 having accommodated therein the first antenna device 24 can be closed by the left rear side door 16 without placing the antenna-side cable 26A between the upper surface cover 20 and the left rear side door 16. In addition, the pump room 13 having accommodated therein the second antenna device 27 can be closed by the right side door 19 without placing the antenna-side cable 29A between the upper surface cover 20 and the right side door 19.

In the embodiment, the cable insert parts are formed by the notch grooves 31, 34, the cable insert parts being disposed in the upper surface cover 20 or the left rear side door 16, and the upper surface cover 20 or the right side door 19 in a state where the left rear side door 16 and the right side door 19 are closed, and end parts of the cable insert parts being formed as opening ends 31A, 34A. According to this configuration, the antenna-side cables 26A, 29A are laterally inserted through the opening ends 31A, 34A in the notch grooves 31, 34 in a state where the left rear side door 16 and the right side door 19 are opened. Therefore, the antenna-side cables 26A, 29A can be prevented from being held between the upper surface cover 20 and the left rear side door 16 and between the upper surface cover 20 and the right side door 19.

In the embodiment, the antenna-side cables 26A, 29A or the notch grooves 31, 34 are provided with the cable protection tools 32, the cable protection tools 32 being respectively fitted into the notch grooves 31, 34 and protecting the antenna-side cables 26A, 29A when the antenna-side cables 26A, 29A are respectively inserted in the notch grooves 31, 34. According to this configuration, the cable protection tools 32 can prevent the antenna-side cables 26A, 29A from rubbing against the notch grooves 31, 34 to be damaged.

In the embodiment, the cable protection tools 32 each are composed of the annular body to be attached to the antenna-side cables 26A, 29A. The antenna-side cables 26A, 29A are axially inserted on the inner peripheral sides of the cable protection tools 32 respectively and the outer peripheral sides of the cable protection tools 32 are respectively fitted into the notch grooves 31, 34. According to this configuration, the cable protection tools 32 are in advance attached to the antenna-side cables 26A, 29A, making it possible to attach the cable protection tools 32 to the notch grooves 31, 34 respectively.

In the embodiment, the cable protection tools 35 each are composed of the C-letter shaped body to be attached to the notch grooves 31, 34. The antenna-side cables 26A, 29A are radially inserted on the inner peripheral sides of the cable protection tools 35 respectively and the outer peripheral sides of the cable protection tools 35 are fitted into the notch grooves 31, 34 respectively. According to this configuration, in a state where the cable protection tools 35 are in advance attached to the notch grooves 31, 34 respectively, it is possible to insert the antenna-side cables 26A, 29A onto the inner peripheral sides of the cable protection tools 35 respectively.

In the embodiment, the heat exchanger room 12 is disposed in the inside of the housing cover 11 to accommodate the heat exchanger 9 mounted on the upper revolving structure 3 and the antenna accommodation room is formed by the heat exchanger room 12. According to this configuration, it is possible to accommodate the first antenna device 24 by using the heat exchanger room 12.

In the embodiment, the first antenna retaining tool 30 is attached to the left rear support member 15A for supporting the housing cover 11. The first antenna retaining tool 30 is disposed in the position where the first antenna device 24 does not overlap with the heat exchanger 9 in the flowing direction of the cooling wind to be supplied to the heat exchanger 9 when the first antenna retaining tool 30 retains the first antenna device 24. According to this configuration, the cooling wind to be supplied to the heat exchanger 9 can be prevented from being interrupted by the first antenna device 24, and the cooling wind can sufficiently be supplied to the heat exchanger 9.

In the embodiment, the partition member 14 is disposed in the inside of the housing cover 11 for the partitioning between the engine room for accommodating the engine 7 mounted on the upper revolving structure 3 and the pump room 13 for accommodating the hydraulic pump 8. The antenna accommodation room is formed by the pump room 13 and the second antenna retaining tool 33 is disposed in the partition member 14. According to this configuration, it is possible to dispose the second antenna retaining tool 33 in the pump room 13 by using the partition member 14.

In the embodiment, the antenna device includes the first antenna device 24 disposed on one side of the upper revolving structure 3 in the left-right direction and the second antenna device 27 disposed on the other side of the upper revolving structure 3 in the left-right direction, and the antenna accommodation room includes the first antenna accommodation room for accommodating the first antenna device 24 and the second antenna accommodation room for accommodating the second antenna device 27, wherein the first antenna accommodation room is formed by the heat exchanger room 12 and the second antenna accommodation room is formed by the pump room 13. According to this configuration, the first and second antenna devices 24, 27 that are arranged to be separated in the left-right direction on the upper revolving structure 3 can individually be accommodated by using the heat exchanger room 12 and the pump room 13.

In the embodiment, the first antenna device 24 is provided with the fitting hole 24A to be fitted to the first antenna attaching tool 25 attached on the upper revolving structure 3, and the first antenna retaining tool 30 includes the base member 30A fixed on the left rear support member 15A and the protrusion member 30B that is attached to the base member 30A to protrude upwards and to which the fitting hole 24A of the first antenna device 24 is fitted. According to this configuration, the first antenna device 24 removed from the first antenna attaching tool 25 can stably be retained by the first antenna retaining tool 30.

It should be noted that the embodiment shows as an example a case where the notch grooves 31, 34 as the cable insert parts are formed in the upper surface cover 20 of the housing cover 11. However, the present invention is not limited thereto but, for example, an embodiment of the present invention may be configured so that the notch groove 31 is formed in the left rear side door 16 and the notch groove 34 is formed in the right side door 19.

In addition, the embodiment shows as an example a case where the first antenna retaining tool 30 is attached to the left rear support member 15A, but, for example, an embodiment of the present invention may be configured so that the first antenna retaining tool 30 is attached to the left intermediate support member 15B. Similarly the embodiment shows as an example a case where the second antenna retaining tool 33 is attached to the partition member 14, but, for example, an embodiment of the present invention may be configured so that the second antenna retaining tool 33 is attached to the right support member 18.

Further, the embodiment is explained by taking the hydraulic excavator 1 provided with the lower traveling structure 2 of the crawler type as an example. However, the present invention is not limited thereto but may be applied to a hydraulic excavator provided with a lower traveling structure of a wheel type.

DESCRIPTION OF REFERENCE NUMERALS

1: HYDRAULIC EXCAVATOR
2: LOWER TRAVELING STRUCTURE (VEHICLE BODY)
3: UPPER REVOLVING STRUCTURE (VEHICLE BODY)
4: WORKING MECHANISM
5: REVOLVING FRAME (VEHICLE BODY FRAME)
8: HYDRAULIC PUMP
9: HEAT EXCHANGER
11: HOUSING COVER
12: HEAT EXCHANGER ROOM (FIRST ANTENNA ACCOMMODATION ROOM)
13: PUMP ROOM (SECOND ANTENNA ACCOMMODATION ROOM)
14: PARTITION MEMBER
15A: LEFT REAR SUPPORT MEMBER (SUPPORT MEMBER)
16: LEFT REAR SIDE DOOR
19: RIGHT SIDE DOOR
24: FIRST ANTENNA DEVICE
24A: FITTING HOLE
25: FIRST ANTENNA ATTACHING TOOL
26: FIRST CABLE
27: SECOND ANTENNA DEVICE
28: SECOND ANTENNA ATTACHING TOOL
29: SECOND CABLE
30: FIRST ANTENNA RETAINING TOOL
30A: BASE MEMBER
30B: PROTRUSION MEMBER
31, 34: NOTCH GROOVE (CABLE INSERT PART)
31A, 34A: OPENING END
32, 35: CABLE PROTECTION TOOL
33: SECOND ANTENNA RETAINING TOOL
33A: BASE MEMBER

The invention claimed is:

1. A construction machine comprising:
an automotive vehicle body; and
a working mechanism disposed on the front side of the vehicle body,
wherein the vehicle body includes:
a vehicle body frame;
a housing cover disposed in the vehicle body frame;
an antenna attaching tool disposed on the rear side of a cab in the vehicle body;
a controller disposed in the vehicle body; and
an antenna device that is removably attached to the antenna attaching tool and is connected via a cable to the controller,
wherein the vehicle body includes:
an antenna accommodation room that is disposed in the inside of the housing cover to accommodate the antenna device removed from the antenna attaching tool to the antenna device; and
an antenna retaining tool that is disposed in the antenna accommodation room to retain the antenna device removed from the antenna attaching tool,
wherein the antenna retaining tool in the antenna accommodation room is configured to retain the antenna device removed from the antenna attaching tool, in a state where the controller and the antenna device are connected via the cable, and
wherein the housing cover is configured to cover the antenna accommodation room in an openable or closable manner and include a door that can be locked in a state where the antenna accommodation room is closed,
wherein the housing cover or the door is provided with a cable insert part, in which the cable is inserted when the antenna device is accommodated in the antenna accommodation room.

2. The construction machine according to claim 1,
wherein the cable insert part is formed by a notch groove disposed in the housing cover or the door, the notch groove having an end part acting as an opening end in a state where the door is closed.

3. The construction machine according to claim 2,
wherein the cable or the notch groove is provided with a cable protection tool, the cable protection tool being fitted into the notch groove to protect the cable when the cable is inserted in the notch groove.

4. The construction machine according to claim 3,
wherein the cable protection tool is composed of an annular body to be attached to the cable,
wherein the cable is axially inserted on an inner peripheral side of the cable protection tool, and
wherein an outer peripheral side of the cable protection tool is fitted into the notch groove.

5. The construction machine according to claim 3,
wherein the cable protection tool is composed of a C-letter shaped body to be attached to the notch groove,
wherein the cable is radially inserted on an inner peripheral side of the cable protection tool, and
wherein an outer peripheral side of the cable protection tool is fitted into the notch groove.

6. The construction machine according to claim 1,
wherein a heat exchanger room is disposed in the inside of the housing cover to accommodate a heat exchanger mounted on the vehicle body, and
wherein the antenna accommodation room is formed by the heat exchanger room.

7. The construction machine according to claim 6,
wherein the antenna retaining tool is attached to a support member for supporting the housing cover, and
wherein the antenna retaining tool is disposed in a position where the antenna device does not overlap with the heat exchanger in a flowing direction of cooling wind to be supplied to the heat exchanger when the antenna retaining tool retains the antenna device.

8. A construction machine comprising:
an automotive vehicle body; and
a working mechanism disposed on the front side of the vehicle body,
wherein the vehicle body includes:
a vehicle body frame;
a housing cover disposed in the vehicle body frame;
an antenna attaching tool disposed on the rear side of a cab in the vehicle body;

a controller disposed in the vehicle body; and an antenna device that is removably attached to the antenna attaching tool and is connected via a cable to the controller, wherein the vehicle body includes:

an antenna accommodation room that is disposed in the inside of the housing cover to accommodate the antenna device removed from the antenna attaching tool to the antenna device; and an antenna retaining tool that is disposed in the antenna accommodation room to retain the antenna device removed from the antenna attaching tool, wherein the antenna retaining tool in the antenna accommodation room is configured to retain the antenna device removed from the antenna attaching tool, in a state where the controller and the antenna device are connected via the cable, and wherein the housing cover is configured to cover the antenna accommodation room in an openable or closable manner and include a door that can be locked in a state where the antenna accommodation room is closed, wherein a partition member is disposed in the inside of the housing cover for the partitioning between a prime mover room for accommodating a prime mover mounted on the vehicle body and a pump room for accommodating a hydraulic pump, wherein the antenna accommodation room is formed by the pump room, and wherein the antenna retaining tool is disposed in the partition member.

9. The construction machine according to claim 1, wherein the antenna device includes:

a first antenna device disposed on one side of the vehicle body in the left-right direction; and a second antenna device disposed on the other side of the vehicle body in the left-right direction, wherein the antenna accommodation room includes:

a first antenna accommodation room for accommodating the first antenna device; and a second antenna accommodation room for accommodating the second antenna device, wherein the first antenna accommodation room is formed by a heat exchanger room disposed in the inside of the housing cover for accommodating a heat exchanger mounted on the vehicle body, and wherein the second antenna accommodation room is formed by a pump room disposed in the inside of the housing cover for accommodating a hydraulic pump mounted on the vehicle body.

10. A construction machine comprising:

an automotive vehicle body; and a working mechanism disposed on the front side of the vehicle body, wherein the vehicle body includes:

a vehicle body frame;

a housing cover disposed in the vehicle body frame;

an antenna attaching tool disposed on the rear side of a cab in the vehicle body;

a controller disposed in the vehicle body; and an antenna device that is removably attached to the antenna attaching tool and is connected via a cable to the controller, wherein the vehicle body includes:

an antenna accommodation room that is disposed in the inside of the housing cover to accommodate the antenna device removed from the antenna attaching tool to the antenna device; and an antenna retaining tool that is disposed in the antenna accommodation room to retain the antenna device removed from the antenna attaching tool, wherein the antenna retaining tool in the antenna accommodation room is configured to retain the antenna device removed from the antenna attaching tool, in a state where the controller and the antenna device are connected via the cable, and wherein the housing cover is configured to cover the antenna accommodation room in an openable or closable manner and include a door that can be locked in a state where the antenna accommodation room is closed, wherein the antenna device is provided with a fitting hole to be fitted to the antenna attaching tool attached on the vehicle body, and wherein the antenna retaining tool includes:

a base member fixed on the vehicle body; and a protrusion member that is attached to the base member to protrude upwards and to which the fitting hole of the antenna device is fitted.

* * * * *